US012571300B2

(12) United States Patent
Abuhaikal et al.

(10) Patent No.: US 12,571,300 B2
(45) Date of Patent: Mar. 10, 2026

(54) TOOL POSITIONING TECHNIQUE

(71) Applicant: Schlumberger Technology Corporation, Sugar Land, TX (US)

(72) Inventors: Muhannad Abdelaziz Abuhaikal, Cambridge, MA (US); Suraj Kiran Raman, Cambridge, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/772,810

(22) Filed: Jul. 15, 2024

(65) Prior Publication Data

US 2025/0020052 A1 Jan. 16, 2025

Related U.S. Application Data

(60) Provisional application No. 63/513,611, filed on Jul. 14, 2023.

(51) Int. Cl.
*E21B 47/04* (2012.01)
*E21B 47/09* (2012.01)

(52) U.S. Cl.
CPC ..... *E21B 47/04* (2013.01); *E21B 47/09* (2013.01)

(58) Field of Classification Search
CPC ..... E21B 47/04; E21B 47/09
See application file for complete search history.

(56) References Cited

U.S. PATENT DOCUMENTS 5,469,916 A * 11/1995 Sas-Jaworsky ..... E21B 47/092 138/104
5,720,345 A * 2/1998 Price ..... G01B 7/28 166/66.5
6,618,675 B2 * 9/2003 Strickland ..... E21B 47/04 702/6
7,047,653 B2 * 5/2006 Fitzgerald ..... E21B 47/04 33/304
7,142,985 B2 * 11/2006 Edwards ..... G01V 9/00 175/45
8,548,742 B2 * 10/2013 Pugh ..... G01P 3/806 702/6

(Continued)

FOREIGN PATENT DOCUMENTS

AU 2023263449 A1 * 6/2024 ..... G01V 3/18
CN 114508343 A * 5/2022 ..... G06T 7/13

(Continued)

OTHER PUBLICATIONS

Search Report and Written Opinion of Internation Application No. PCT/US2024/038010 dated Oct. 22, 2024, 10 pages.

*Primary Examiner* — Jennifer H Gay
(74) *Attorney, Agent, or Firm* — Kyle R. Miiller

(57) ABSTRACT

Systems and techniques for establishing tool location in a well and conveyance line characteristics of a conveyance line accommodating the tool. The systems and techniques are directed at a closed loop manner of acquiring well location information. Thus, multiple pass detections of a well feature may be utilized to map, update and/or provide well location information in addition to conveyance line characteristic information in real-time. This may occur in absence of prior stored well mapping information or with supplemental information thereof.

22 Claims, 5 Drawing Sheets

(56) References Cited

U.S. PATENT DOCUMENTS 8,875,785 B2 * 11/2014 Coles ..... E21B 47/04 166/250.01
9,002,648 B2 * 4/2015 Pfutzner ..... G01V 1/16 702/6
9,175,559 B2 * 11/2015 Dowla ..... E21B 17/08
9,540,927 B2 * 1/2017 Mann ..... E21B 47/04
10,422,213 B2 * 9/2019 Van Der Ende ..... E21B 47/04
11,761,327 B2 * 9/2023 Merino ..... E21B 47/09 166/255.1
12,110,786 B1 * 10/2024 Al-Qarni ..... E21B 47/09
2002/0198661 A1 * 12/2002 Strickland ..... E21B 47/04 702/6
2004/0020647 A1 * 2/2004 Snoga ..... E21B 47/026 166/250.11
2005/0138830 A1 * 6/2005 Fitzgerald ..... E21B 47/04 33/773
2009/0078413 A1 * 3/2009 Tubel ..... E21B 47/14 166/64
2009/0277630 A1 * 11/2009 McDaniel ..... G01S 13/88 166/250.1
2010/0097450 A1 * 4/2010 Pugh ..... G01P 3/806 348/222.1
2011/0185806 A1 * 8/2011 Pfutzner ..... G01V 7/06 73/382 R
2011/0290011 A1 * 12/2011 Dowla ..... E21B 17/08 73/152.16
2013/0008646 A1 1/2013 Blount
2014/0202691 A1 * 7/2014 Coles ..... E21B 47/01 166/255.1
2015/0035536 A1 * 2/2015 Tang ..... G01V 3/20 324/339
2015/0233239 A1 * 8/2015 Wang ..... E21B 47/09 166/252.5
2015/0285069 A1 * 10/2015 Mann ..... E21B 47/092 166/255.1
2016/0053608 A1 2/2016 Dowla
2017/0030187 A1 * 2/2017 Fulton ..... E21B 47/10
2017/0159423 A1 * 6/2017 Merino ..... E21B 47/12
2017/0306749 A1 * 10/2017 Van Der Ende ..... E21B 47/04
2019/0390543 A1 * 12/2019 Merino ..... E21B 49/00
2022/0342111 A1 * 10/2022 Liang ..... E21B 49/00
2024/0142657 A1 * 5/2024 Sayed ..... G01N 33/2823
2024/0287860 A1 * 8/2024 Su ..... E21B 17/206
2024/0318542 A1 * 9/2024 Jackson ..... E21B 47/04
2025/0020052 A1 * 1/2025 Abuhaikal ..... E21B 47/09
2025/0027402 A1 * 1/2025 Abuhaikal ..... E21B 47/04
2025/0059883 A1 * 2/2025 Appleby ..... G01F 23/14
2025/0067168 A1 * 2/2025 Raman ..... G01B 11/002
2025/0147196 A1 * 5/2025 Woodroffe ..... G01V 1/166

FOREIGN PATENT DOCUMENTS

CN 114508343 B * 4/2025 ..... G06T 7/13
EP 3263832 A1 * 1/2018 ..... E21B 47/26
WO WO-2017192154 A1 * 11/2017 ..... G06F 30/20
WO 2019118963 A1 6/2019
WO 2023177767 A1 9/2023

* cited by examiner

TOOL POSITIONING TECHNIQUE

CROSS REFERENCE TO RELATED APPLICATION(S)

This Patent Document claims priority under 35 U.S.C. § 119 to U.S. Provisional Application Ser. No. 63/513,611, entitled Conveyance Depth Estimation and Control, filed on Jul. 14, 2023, which is incorporated herein by reference in its entirety.

BACKGROUND

Exploring, drilling and completing hydrocarbon and other wells are generally complicated, time consuming, and ultimately very expensive endeavors. As a result, over the years, a significant amount of added emphasis has been placed on well profiling, monitoring and maintenance. By the same token, perhaps even more emphasis has been directed at initial well architecture and design. All in all, careful attention to design, monitoring and maintenance may help maximize production and extend well life. Thus, a substantial return on the investment in the completed well may be better ensured.

From the time the well is drilled and continuing through to various stages of completions and later operations, profiling and monitoring of well conditions may play a critical role in maximizing production and extending the life of the well as noted above. Certain measurements of downhole conditions may be ascertained through permanently installed sensors and other instrumentation. However, for a more complete picture of well conditions, an interventional logging application may take place with a logging tool advanced through the well. In this way depth correlated information in terms of formation characteristics, pressure, temperature, flowrate, fluid types, and others may be retrieved. So, for example, an overall production profile of the well may be understood in terms of the dynamic contributions of various well segments. This may provide operators with insight into expected production over time and guidance in terms of current or future corrective maintenance. Of course, the well may require the introduction of an interventional application for sake of installation, retrieval, clean-out or any number of other issues that may arise throughout the life of the well.

Regardless, interventional applications have become a more complicated undertaking over the years. Specifically, wells are now more likely to be of greater depths and more complex architecture. For example, whether it be a logging tool or a more directly interventional tool for an interventional application, there may be a need for routing through different tortouos horizontal sections. Coiled tubing is often adequately employed for advancement of the logging or interventional tool through the entirety of the well. However, in addition to the advancement itself, there is also the often critical need of confirming tool location with accuracy. That is, even where the hurdle of challenging advancement is overcome with coiled tubing, tractoring or other techniques, carrying out the appropriate application at the appropriate location remains of importance. By way of example, reaching extreme depths only to perforate at the incorrect location may not only be ineffective but may also require follow-on additional corrective applications.

Depth correlations may be more of a challenge where wells reach extensive depths such as 10,000 to 20,000 feet or more as noted above. This is because the conveyance utilized to reach such depths is likely to have a growing load and a natural elasticity, be prone to some degree of thermal expansion and be prone to kinking and other characteristics that render depth determinations difficult to estimate with precision. That is, simply monitoring the amount of conveyance line deployed from a reel at a surface of the oilfield often fails to render a complete and accurate picture. Indeed, depending on tool, line and downhole conditions, where 10,000 feet of conveyance has been deployed from a reel at surface, it would not be uncommon for location determinations to be off by up to 3-9 feet or more where only reel deployment metering was used to estimate such location determinations.

In order to address this issue of imprecision, present technology relies on supplemental information gathered from various sources in addition to a meter at the surface reel. This generally includes the detection of downhole features at known locations, such as casing collars. These detections are acquired during deployment. In this way, an ongoing calibration is available. For example, consider a circumstance where the surface information indicates that 9,997 feet of cable have been deployed but a casing collar at a known 10,000 foot location has been detected. Where this is the case, it is apparent that due to elasticity, thermal expansion or for some other reason, the surface information is off by about 3 feet. Thus, for a completion that utilizes casing collars at ten feet intervals, every ten feet a recalibration of the deployment depth is available for operators to use in determining the conveyance depth with better accuracy. Of course, this example and these numbers are only exemplary.

Unfortunately, the process of calibrating the depth location as described above is quite inefficient. For example, it is standard practice to calibrate by dropping the conveyance line and detector to a substantial depth and withdrawing the line. During the withdrawal, a toolstring accommodating the detector may pause at each casing collar or other known location detection for sake of calibrating. Even though each pause may take only a few minutes, cumulatively, this may translate into a significant delay. As a result, operations may be delayed by a day or more to complete the calibrations. At present, there is not a more efficient mode of obtaining these calibrations for sake of location accuracy in support of subsequent downhole conveyance facilitated operations.

SUMMARY

A method of estimating well depth of a downhole conveyance line. The method includes deploying the line into a well with a locator tool. A well feature is detected with the tool and a characteristic of the line is determined in conjunction with the detecting of the well feature. An estimated well depth is established with information from the detecting of the well feature and from the determining of the conveyance line characteristic.

DETAILED DESCRIPTION

In the following description, numerous details are set forth to provide an understanding of the present disclosure. However, it will be understood by those skilled in the art that the embodiments described may be practiced without these particular details. Further, numerous variations or modifications may be employed which remain contemplated by the embodiments as specifically described.

Embodiments herein are described with reference to certain types of logging applications. For example, a logging tool may be provided in the form of an extended toolstring with logging tool components, a detector and an application tool. Of course, a variety of different types of application tools may take advantage of the unique deployment and locating features detailed herein. For example, the toolstring may be adapted for performing different types of interventional applications such as a coiled tubing driven cleanout illustrated. Regardless, so long as the tools and techniques utilized provide both location information and conveyance line characteristic information for real time estimations, appreciable benefit may be realized.

Figure 1A:
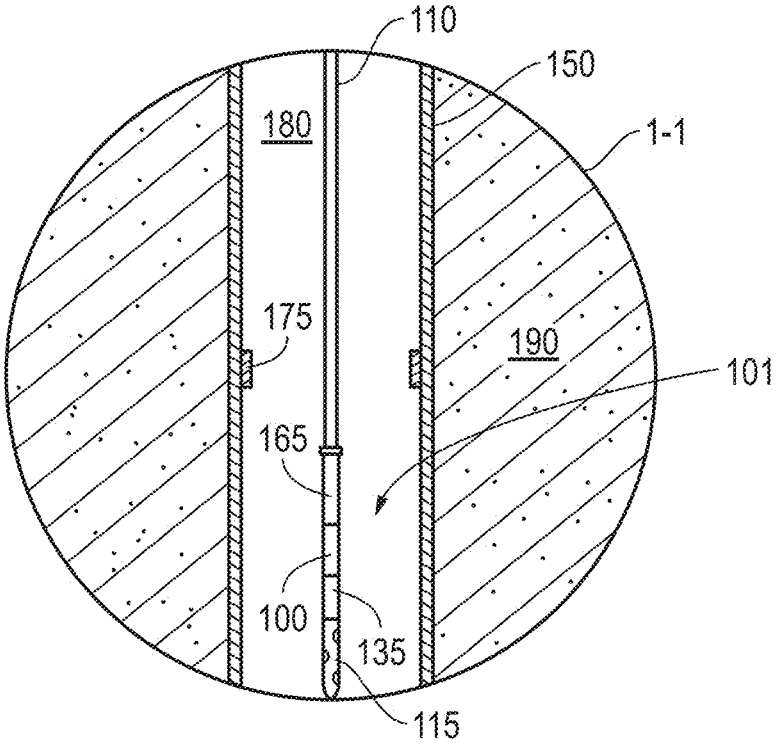
FIG. 1A is an enlarged side sectional view of a downhole conveyance line in a well taken from 1-1 of FIG. 2 and accommodating a locator tool for detection of a downhole well feature.
Figure 2:
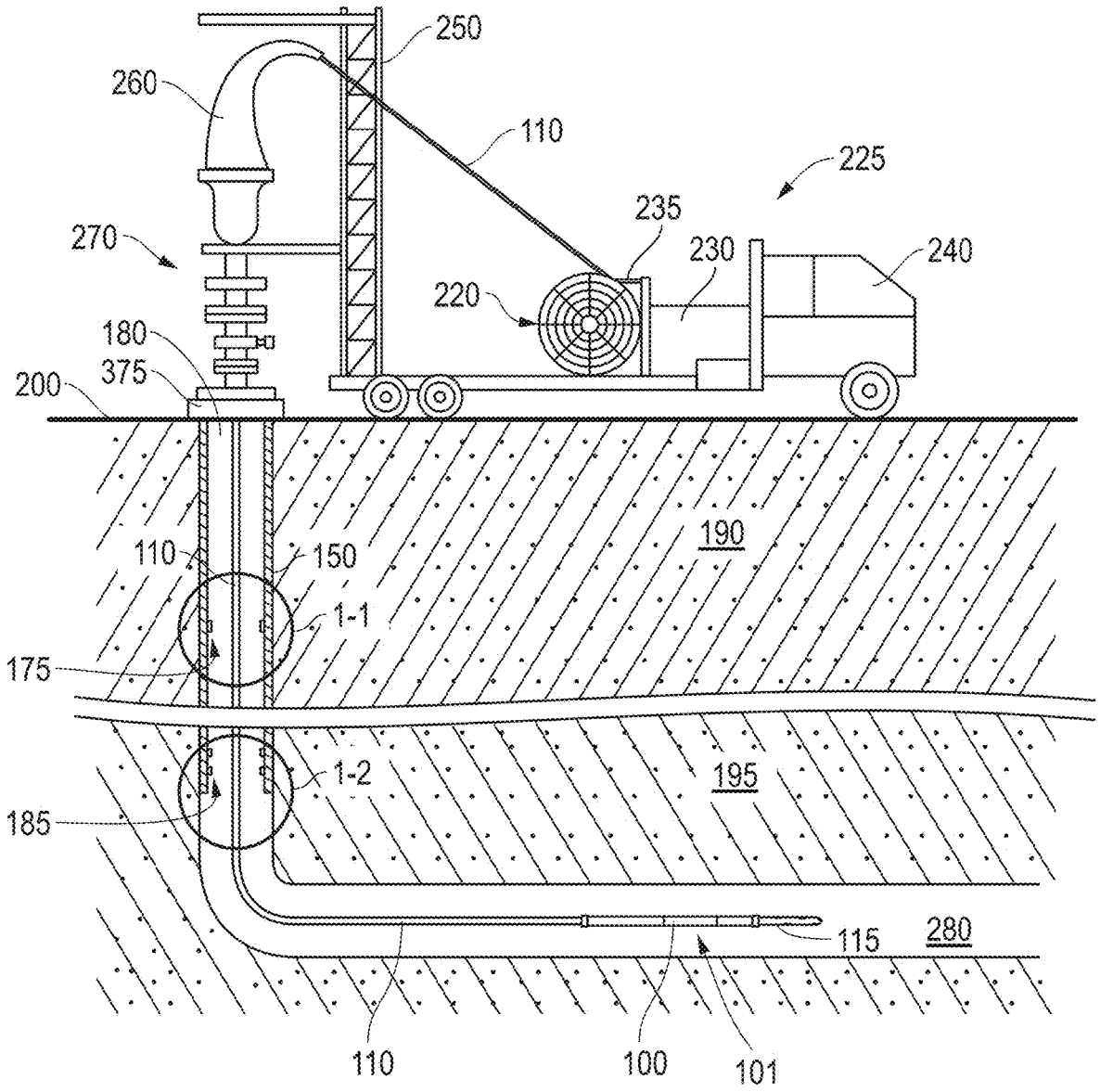
FIG. 2 is an overview depiction of a well at an oilfield with the different downhole locations of FIGS. 1A and 1B both illustrated.

Referring now to FIG. 1A, an enlarged side sectional view of a downhole conveyance line 110 in a well 180 taken from 1-1 of FIG. 2 is illustrated. The line 110 accommodates a BHA (bottom hole assembly) or toolstring 101 that includes a locator tool 100. For the embodiment illustrated, additional logging tools 135, 165 are also included along with an interventional tool 115, in this case a cleanout tool. However, a variety of other passive or more directly interventional tools may also be employed. The locator tool 100 may be a conventional casing collar locator (CCL) or a centralizer detector. However, where utilized to provide location information, the logging tools 135 165 illustrated and/or others may also be considered locator tools.

Continuing with reference to FIG. 1A, the well 180 may include conventional completion hardware such as a casing 150, a casing collar 175 and other typical features. Features like the casing collar 175 may be uniquely identifiable by the locator tool 100. For example, the depicted casing collar 175 may be of its own unique architecture or signature so as to differentiate it from another collar 185 such as that depicted in FIG. 1B. Thus, the locator tool 100 may identify the first collar 175 from the second 185. In the same way, a host of other joints, valves or other permanent structures of the hardware may also be uniquely detectable and differentiated from one another. Such information may be stored in advance of operations so as to provide an idea of particular downhole locations and/or depths within the well 180. Additionally, this information may also be mapped even in absence of stored location information as detailed further below. That is, through techniques detailed herein, real-time correlations regarding well depth may be ascertained in absence of pausing for calculations to estimate depth. Instead, multiple pass, closed loop detections may be utilized to build a well map and profile without cause for significant delays to run calculations and correlations. In this sense, the techniques detailed herein may be considered real-time machine learning as opposed to a more limited reference log available for manual correlating calculations by field engineers that require substantially more time due to the noted pauses required.

Figure 1B:
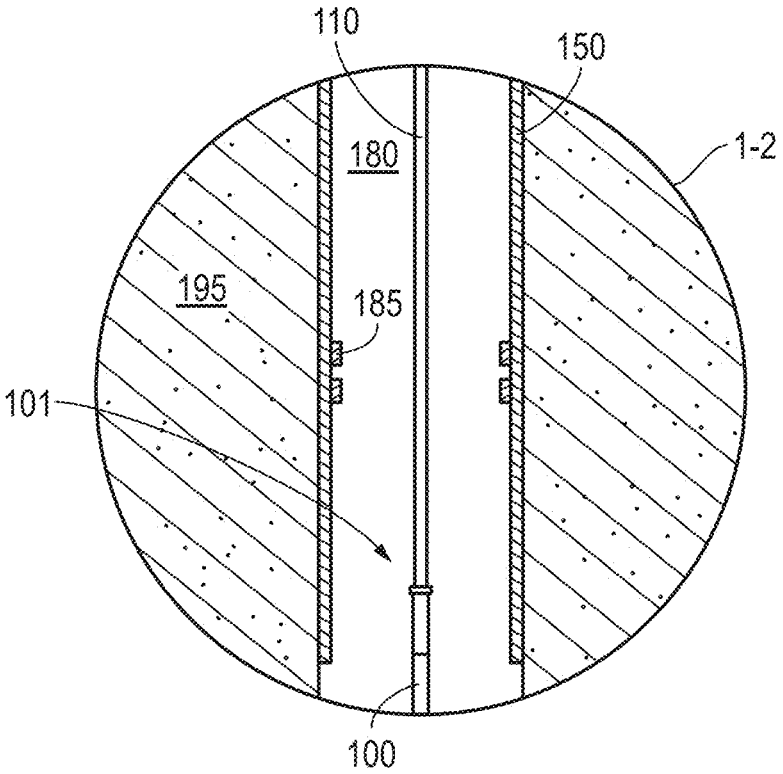
FIG. 1B is an enlarged side sectional view of the line of FIG. 1A taken from 1-2 of FIG. 2 and accommodating the tool at a different downhole location in the well.

In addition to features such as collars 175, the well 180 is also surrounded by a formation 190 that may change from one location to another (e.g. the formation 195 of FIG. 1B may be of a character that is different from the character of the formation 190 of FIG. 1A). In this sense, the logging tools 135, 165 may also serve as locator tools by gathering unique formation signature characteristics. For example, in one embodiment, at least one of the logging tools 135, 165 is a gamma ray tool configured to obtain identifiable formation characteristics that may be readily correlated to prior stored information or utilized for sake of updating or building initial formation mapping information. To this end, the logging tools 135 may also consist of a resistivity sensor, an acoustic sensor or a density measurement sensor, in addition to the noted locator 100. Thus, even apart from depth determinations or a suggested cleanout, formation sampling and other wellbore measurements and interventions may be undertaken.

Referring now more specifically to FIG. 1B, an enlarged side sectional view of the line 110 of FIG. 1A taken from 1-2 of FIG. 2 is illustrated. As suggested above, the toolstring 101 is positioned at a different downhole location in the well 180. More specifically, in this example, the toolstring 101 is now downhole of the location illustrated in FIG. 1A above. Notice the difference between the more downhole collar 185 of FIG. 1B versus the collar 175 of FIG. 1A. Additionally, the more downhole formation 195 may be of a different character than that of the more uphole formation 190 referenced above. These different, distinguishable characteristics of the environment provide unique location signatures. As detailed below, when detected and utilized in the unique manners described herein, the requirement of pausing, correlating and calculating to establish depth may be avoided and information regarding the line 110 itself may be ascertained.

Referring now to FIG. 2, an overview depiction of the well 180 at an oilfield 200 is illustrated with the different downhole locations of FIGS. 1A and 1B both shown at 1-1 and 1-2, respectively. The toolstring 101 is shown after proceeding downhole from the oilfield 200 and past both locations 1-1, 1-2. In order to ascertain depth information regarding the toolstring 101, the conveyance line 110 is metered out from the reel 220 of the coiled tubing equipment 225 at surface as it is metered by a counter 235 as described above so as to allow for a loop closure technique to be employed.

For the example application of FIG. 2, coiled tubing operations are shown. That is, the equipment 225 includes the noted coiled tubing 110, reel 220 and a control unit 230 which are delivered to the oilfield 200 in a mobile fashion by a coiled tubing truck 240. A mobile rig 250 supports a conventional gooseneck injector 260 for forcibly advancing or withdrawing the coiled tubing 110 through the well 180. The injector 260 is utilized to facilitate and govern the relatively stiff coiled tubing 110 in movement, particularly through the wellhead 375 and BOP stack 270 which present a fair amount of valve and other resistance to the coiled tubing 110 movement. Of course, as suggested, the coiled tubing operations illustrated are only exemplary and any form of conveyance line facilitated operations to a designated downhole location may benefit from the techniques detailed herein.

Continuing with reference to FIG. 2, rather than pausing for calculations and correlating at each collar 175, 185, the control unit 230 of the equipment 225 may direct the toolstring 101 to engage in multiple trips past each collar location upon detection by the locator 100. For example, with the toolstring 101 moving in a downhole direction 280, this means that once the locator 100 has detected a collar 175, 185, this information may be stored at a processor of the control unit 230. This, in turn, may initiate a protocol where the toolstring 101 is withdrawn until the same collar detections are again acquired. This multiple pass, loop closure manner of acquiring depth information is done in conjunction with information from the counter 235 also being fed to the control unit 230. So, for example, the counter 235 may indicate that a detection of the uphole collar 175 was made at 5,000 feet as measured from surface. Following this detection, the conveyance line 110 and toolstring 101 may continue to advance downhole until the next downhole collar 185 is detected, perhaps at 7,500 feet as measured from the counter 235 at surface. Of course, the numbers are only exemplary and the actual depth may not exactly correlate to the information from the counter 235 due to expansion, contraction, kinking or a variety of other factors as described above.

Once complete passes of the known downhole features (the collars 175, 185) have occurred, the control unit 230 may then direct withdrawing of the conveyance line 110 back uphole until the detections of the collars 175, 185 are again acquired. This might be expected to occur where the counter information corresponds to 5,000 and 7,500 feet of depth according to the present example. However, as noted above, various changes in the line 110 may occur along the way such that the detections occur at different depths as correlated to the information from the counter 235. Nevertheless, these known features 175, 185 are static and have not moved. Therefore, the discrepancy is due to the dynamic nature of the conveyance line 110 itself for such reasons as those noted above. As a result, this discrepancy information may be utilized to provide information as to the condition of the line 110 itself when combined with information from the counter 235 in addition to a host of other information. Ultimately, a fusion of all of this information may be combined at the control unit 230 to estimate both real-time depth information and line character information as detailed further below.

For the above manner of estimating depth, note that there are two types of depth, the actual physical depth of the toolstring 101 as measured from the surface and relative depth. The relative depth is the depth estimated with reference to a known feature, such as a collar 175, 185. Known features may also include distinct geological markers detectable by a gamma ray measurement, a resistivity measurement, acoustics and/or other measurements facilitated by logging tools 135, 165 of the toolstring 101 as noted above (see FIG. 1A).

The above described technique is done in absence of extended pauses for calculations. Indeed, even with multiple passes, the absence of pausing means that mapping, enhanced accuracy depth estimates and line condition information may all be ascertained in a matter of minutes or perhaps a couple of hours as opposed to one or more days. Once more, this all may be achieved with the same conveyance line 110 and toolstring 101 which are utilized to facilitate the application for which the depth information was sought. For the example illustrated, a cleanout tool 115 for a follow-on cleanout application at the proper location is shown. However, follow on applications may include formation sampling, logging, a variety of interventions and any number of other applications.

Figure 3:
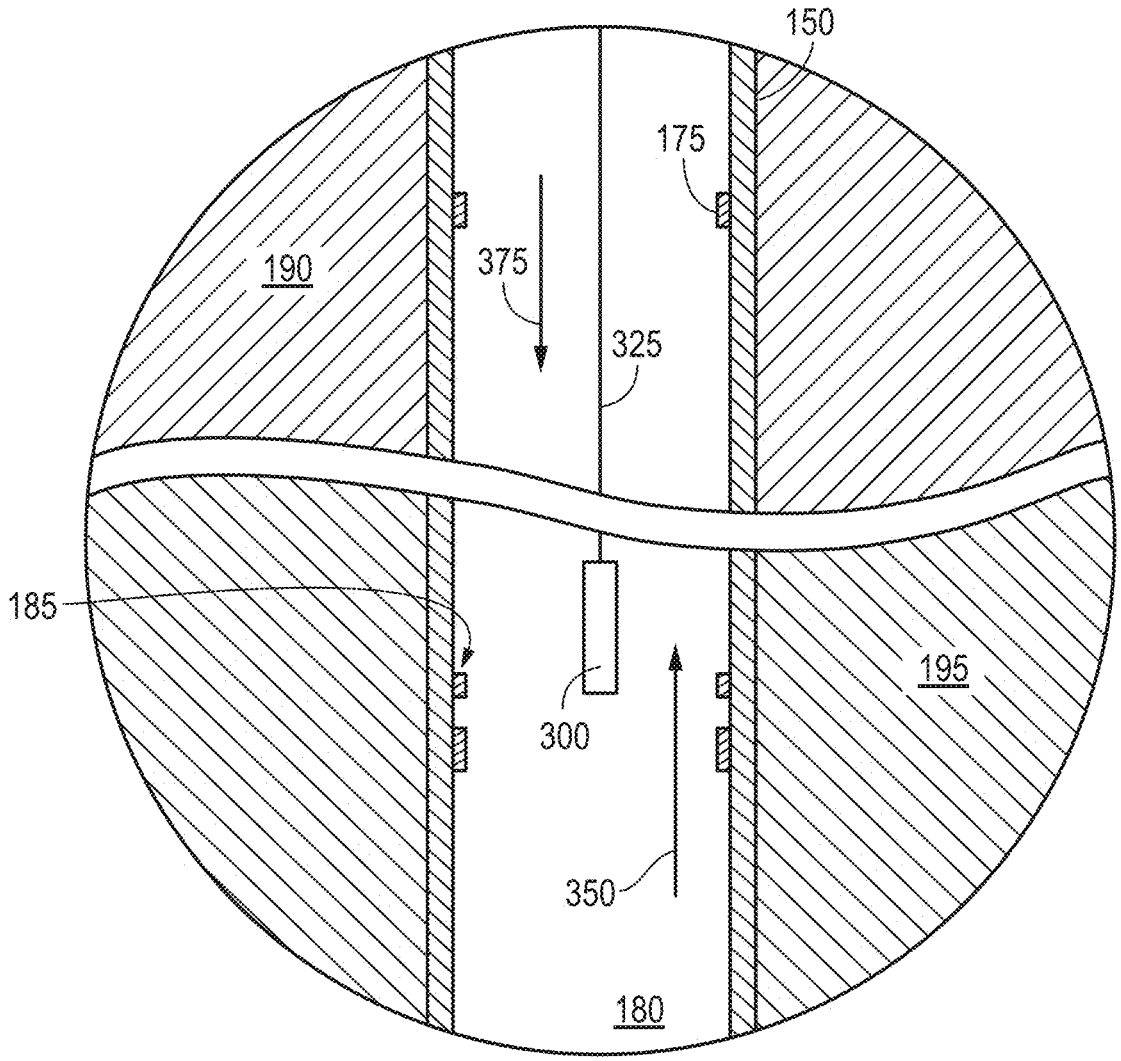
FIG. 3 is an enlarged sectional view of the well of FIG. 2 accommodating a different conveyance line and tool for both downhole and uphole movement adjacent different well features for unique detections thereof.

Referring now to FIG. 3, an enlarged sectional view of the well 180 of FIG. 2 is shown. In this example, the conveyance line 325 is wireline accommodating a toolstring in the form of a logging tool 300. Slickline may also be employed in this manner, for example, where outfitted with fiber optics to support real-time communications. Regardless, in the wireline instance illustrated, the logging tool 300 serves as a locator tool for either detecting well features 175, 185 installed at the casing 150 or certain mappable characteristics at different formations 190, 195. Of course, given that the toolstring is a logging tool 300, it may also acquire additional information related to pressure, temperature or downhole fluids.

Continuing with reference to FIG. 3, note that sufficient location information is provided where the locator 300 passes by one or more casing collars 175, 185 (in this instance) on multiple "closed loop" passes, one going downhole 375 and one returning uphole 350. This may occur by sending the tool 300 through the entirety of the well 180 and then withdrawing the tool 300 back uphole. Alternatively, the tool 300 may be sent through the well 180 in a more intermittent and limited manner. For example, a given section of the well 180 may be "mapped" with both downhole 375 and uphole 350 travel in the section followed by repeating the process at a subsequent section. This may be beneficial, for example, whenever a casing collar 175 or 185 is detected to confirm the absence of any potential false positive detection. Of course, operators may also choose this mode of mapping for any number of other reasons as well.

Figure 4:
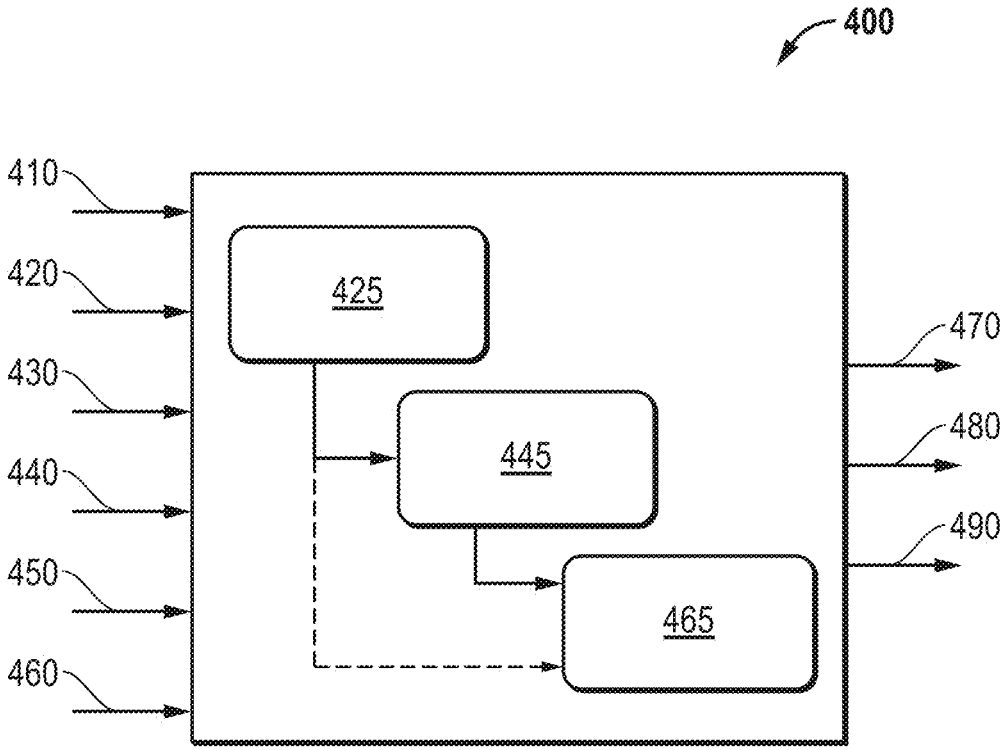
FIG. 4 is a schematic representation of employing a fusion of well and conveyance line determinations to estimate well depth.

Referring now to FIG. 4, a schematic representation 400 of employing a fusion of well and conveyance line determinations to estimate well depth is illustrated. More specifically, with added reference to FIG. 2, a fusion processor 465 at the control unit 230 obtains information from a locator 425. This information may or may not be cross-referenced with a stored signature 445. At this point, this depth related detection information is combined with a host of other information (e.g. 410, 420, 430, 440, 450, and/or 460) so as to provide depth estimates 470, 480, 490. Additionally, estimates regarding the character of the conveyance line which facilitates the operations may also be obtained. By way of reference to the more specific coiled tubing operations example above, this means that once a locator tool 100 has detected the presence of a collar 175, 185 an association with a particular signature for each collar 175, 185 may be made (e.g. at 445). This detection information is routed to the fusion processor 465 where other information may be fused for mapping, whether it be updating or generating, and in real-time. Apart from the collar detection 410, other information may include depth as measured at the reel from surface 420, the speed of the cable measured at surface 430, a time stamp of the detection 440, additional information from other logging tools regarding a formation feature 450 or even prior mapping information 460.

With added reference to FIGS. 2 and 3, the information taken together in real-time and in a closed-loop manner, such that it is calibrated against itself (e.g. during multiple passes), the fusion may take place in a much more accelerated manner to provide estimates of enhanced accuracy. These estimates may be of absolute depth 470, relative depth 480 and even take note of certain depth uncertainties 490. Additionally, recalling the examples of a coiled tubing or wireline run, information regarding the conveyance line 110, 325 itself may also be ascertainable due to the closed loop manner of running the operation. So, for example, depending on the weight or geometry of the toolstring 101, 300 different visco-elastic properties of the conveyance line 110, 325, force distribution, increasing or decreasing well temperatures and/or pressures may affect the line 110, 325 differently depending on whether or not the toolstring is moving in a downhole direction 375 or uphole 350. Even differing speed of movement, downhole versus uphole, may make a difference and be accounted for. Once fused 465, the enhanced depth estimates 470, 480, 490 may be ascertained. More specifically, a Bayesian sensor fusion framework of the fusing processor 465 may be utilized to assemble and process the acquired information 410, 420, 430, 440, 450 and/or 460.

Additionally, the technique described above also provides information regarding the character of the line 110, 325 itself. For example, the degree of line stretch or contraction during the closed loop process not only helps provide the enhanced depth information 470, 480, 490, but also provides information as to the real-time character of the line 110, 325.

Ultimately, the closed loop technique provides an automated, machine learning workflow that does not require prior stored information, though its use may occur, to provide a more accurate estimate of depth and location. Once more, this occurs in a matter of minutes to hours, depending on various factors such as the overall depth of the well, as opposed to conventional operations that may take a day or more to complete and provide less accuracy.

Figure 5:
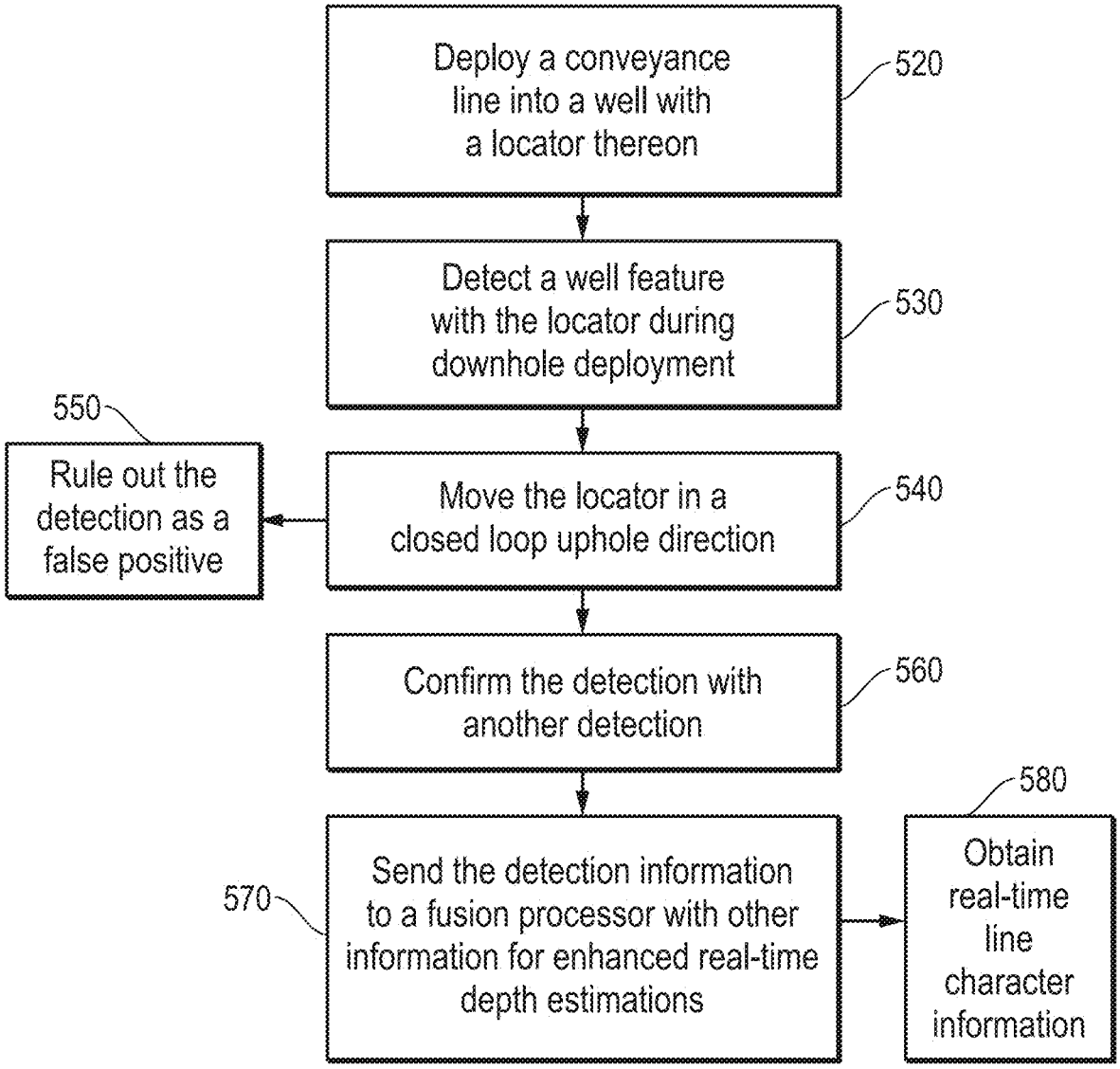
FIG. 5 is a flow-chart summarizing an embodiment of utilizing a tool locating device to estimate conveyance line tool depth and conveyance line characteristics.

Referring now to FIG. 5, a flow-chart summarizing an embodiment of utilizing a tool locating device to estimate conveyance line tool depth and conveyance line characteristics is shown. Specifically, a conveyance line is deployed into a well with a locator tool thereon as indicated at 520. Apart from a casing collar locator, this tool may be any of a variety of tools for detecting a well feature during this downhole movement as indicated at 530. Once the detection takes place, the line and the locator may be moved in an uphole direction as noted at 540. Thus, the initial detection may be ruled out as a false positive as noted at 550 or confirmed as indicated at 560. This closed loop manner of locator movement past the detected feature location multiple times provides a host of unique advantages when estimating location information. Namely, as indicated at 570, the acquired multiple pass information may be directed to a fusion processor along with other acquired information for enhanced real-time depth estimates. This also provides real-time line character information so as to determine the condition of the line itself (see 580).

Embodiments described hereinabove provide devices and techniques that allow for the acquisition of real-time well depth estimates that avoids extended pauses for calibrating according to current techniques that rely on pre-stored depth information. Thus, delays of a day or more before running a well application at an estimated location may be avoided. Instead, real-time fusion processing may be utilized to provide more enhanced and accurate depth estimates and mapping without such significant delays. Indeed, no pauses between detections are required other than to move from downhole movement of the toolstring to uphole movement for the closed loop technique described.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A system for establishing estimated well depths in a well, the system comprising:

a tool string coupled to a well conveyance line, the tool string including a locator tool configured to detect a plurality of measurement locations while being lowered within a wellbore and while being raised within the wellbore, the locator tool conducting multiple passes by the plurality of measurement locations, wherein, during each of said multiple passes, the locator tool passes by and detects consecutive measurement locations of the plurality of measurement locations without pausing during or between detections; and a control unit at a surface location adjacent the well, the control unit including a processor configured to:

receive location information corresponding to detections of the consecutive measurement locations of the plurality of measurement locations from the locator tool obtained during the multiple passes, and combine or fuse the location information with other downhole information in real-time to establish the estimated well depths and well conveyance line condition information without pauses for calculations during or between detections.

2. The system of claim 1, wherein the location information and the other downhole information comprise one or more of: a collar detection, a depth measured from the surface location, a speed of the well conveyance line measured from the surface location, a time stamp of the collar detection, a detected formation characteristic, or prior downhole mapping information.

3. The system of claim 2, wherein the well is defined by a casing comprising a plurality of collars at known locations to facilitate the collar detection.

4. The system of claim 2, further comprising a reel at the surface location with a counter configured to facilitate the depth measured from the surface location.

5. The system of claim 1, wherein the well conveyance line comprises one of: slickline, wireline, or coiled tubing.

6. The system of claim 1, wherein the locator tool includes one or more of: a logging tool, a casing collar locator, a centralizer detector, an acoustic detector, a gamma ray detector, a resistivity sensor, or a density measurement sensor.

7. The system of claim 1, wherein:

the location information comprises:

first information corresponding to each of the plurality of measurement locations on a downhole direction pass, the first information comprising, for each of the plurality of measurement locations: identification information of a well feature at the measurement location, a depth as measured from a well surface, a speed of the well conveyance line measured at the well surface, a time stamp, logging tool information regarding a formation feature corresponding to the well, and any available prior mapping information for the well feature; and second information corresponding to each of the plurality of measurement locations on an uphole direction pass, the second information comprising, for each of the plurality of measurement locations: identification information of a well feature at the measurement location, a depth as measured from the well surface, a speed of the well conveyance line measured at the well surface, a time stamp, logging tool information regarding the formation feature corresponding to the well, and any available prior mapping information for the well feature; and the processor combines or fuses the location information using a Bayesian sensor fusion framework to assemble and process the location information and the other downhole information.

8. A method of estimating well depth at a location in a well, the method comprising:

deploying, using a downhole conveyance line, a tool string including a locator tool into the well;

conducting, with the locator tool, multiple passes by a plurality of locations without pausing during or between detections at consecutive locations;

detecting, during each of the multiple passes, a plurality of well features with the locator tool, the plurality of well features corresponding to consecutive locations of the plurality of locations, the detecting occurring without pausing during or between consecutive detections;

determining downhole conveyance line characteristic with information from the detecting of the plurality of well features; and estimating well depths at the plurality of locations with information from the detecting of the plurality of well features and information from the determining of the downhole conveyance line characteristic, the estimating occurring in real-time without pauses for calculations.

9. The method of claim 8, further comprising confirming the detecting of at least one well feature of the plurality of well features as a false detection during a pass in the uphole direction.

10. The method of claim 8, wherein the determining of the characteristic of the downhole conveyance line and the estimating of the well depths are facilitated by a fusion processor of a control unit at a well surface adjacent to the well.

11. The method of claim 10, wherein the fusion processor provides the determining of the characteristic and the estimating of the well depths in real-time in an absence of prior well mapping information.

12. The method of claim 8, wherein the information from the detecting of the plurality of well features and the information from the downhole conveyance line characteristic is relative to one or more of: a collar detection, a depth measured from a surface location adjacent the well, a speed of the downhole conveyance line measured from the surface location, a time stamp of the collar detection, a detected formation characteristic, or prior downhole mapping information.

13. The method of claim 8, further comprising performing an application in the well at at least one location of the plurality of locations.

14. The method of claim 13, wherein the application is one of a cleanout application and a formation sampling application.

15. The method of claim 8, wherein the estimating of the well depths relates to one of absolute depth and relative depth.

16. The method of claim 8, wherein:

the conducting, with the locator tool, multiple passes by a plurality of locations comprises automatically controlling the tool string to:

lower, using the downhole conveyance line, the tool string including the locator tool into the well on a downhole direction pass; and withdraw the tool string including the locator tool in an uphole direction until each of the plurality of well features is detected again by the locator tool in an uphole direction pass from the well;

the detecting the plurality of well features with the locator tool comprises:

detecting, by the locator tool, each of the plurality of well features on the downhole direction pass of the tool string into the well;

storing first information corresponding to each detection of each of the plurality of well features on the downhole direction pass, the first information comprising, for each detection: identification information of the corresponding well feature, a depth as measured from a well surface, a speed of the downhole conveyance line measured at the well surface, a time stamp, logging tool information regarding a formation feature corresponding to the well, and any available prior mapping information for the corresponding well feature;

detecting, by the locator tool, each of the plurality of well features on the uphole direction pass of the tool string from the well; and storing second information corresponding to each detection of each of the plurality of well features on the uphole direction pass, the second information comprising, for each detection: identification information of the corresponding well feature, a depth as measured from the well surface, a speed of the downhole conveyance line measured at the well surface, a time stamp, logging tool information regarding the formation feature corresponding to the well, and any available prior mapping information for the corresponding well feature; and the estimating the well depths comprises using the first information and the second information to:

determine discrepancy information comprising a difference between the first information depth as measured from the well surface and the second information depth as measured from the well surface;

determine an absolute depth of the tool string at each of the plurality of well features;

determine a relative depth of each of the plurality of well features; and determine depth uncertainty information for each of the plurality of well features.

17. A well conveyance line system, comprising:

a well conveyance line coupled to surface equipment adjacent to a well;

a tool string coupled to the well conveyance line and in communication with a control unit of the surface equipment, the tool string including a locator tool configured to detect a plurality of signature locations in the well, wherein the locator tool is configured to conduct, in a closed loop manner without pausing during or between detections, a first pass by the plurality of signature locations in a first direction and a second pass by the plurality of signature locations in a second direction opposite the first direction, wherein, during each of said first and second passes, the locator tool is further configured to pass by and detect consecutive signature locations of the plurality of signature locations without pausing during or between consecutive detections; and a processor of the control unit, the processor being configured to:

receive detections of the plurality of signature locations in the closed loop manner; and combine the detections with one of additional information relative to the well and the well conveyance line in real-time to establish estimated well depth and conveyance line condition information without pauses for calculations.

18. The well conveyance line system of claim 17, wherein the plurality of signature locations in the well is relative to one or more of: a casing collar, a joint, a valve, or a formation characteristic.

19. The well conveyance line system of claim 17, wherein the locator tool includes one or more of: a logging tool or a casing collar locator.

20. The well conveyance line system of claim 17, wherein the processor obtains the plurality of signature locations in an absence of prior well mapping information.

21. The well conveyance line system of claim 17, wherein the processor obtains the plurality of signature locations in combination with prior well mapping information.

22. The well conveyance line system of claim 17, wherein the processor is further configured to determine visco-elastic properties of the well conveyance line based on differences in detections of the signature locations during movement in the first direction versus movement in the second direction.

* * * * *